US005557865A

United States Patent [19]

Sjösvärd

[11] Patent Number: 5,557,865

[45] Date of Patent: Sep. 24, 1996

[54] ANTI-SKID DEVICE FOR FOOTWEAR

[75] Inventor: Bertil Sjösvärd, Västra Frölunda, Sweden

[73] Assignee: Monica Sjosvard, Vastra Frolunda, Sweden

[21] Appl. No.: 256,917

[22] PCT Filed: Jan. 25, 1993

[86] PCT No.: PCT/SE93/00049

§ 371 Date: Mar. 8, 1995

§ 102(e) Date: Mar. 8, 1995

[87] PCT Pub. No.: WO93/14664

PCT Pub. Date: Aug. 5, 1993

[30] Foreign Application Priority Data

Jan. 30, 1992 [SE] Sweden ..... 9200257

[51] Int. Cl.[6] ..... A43C 15/00; A43B 5/00

[52] U.S. Cl. ..... 36/61; 36/134

[58] Field of Search ..... 36/61, 134, 703, 36/114, 135, 7.6, 59 B, 62, 67 R, 67 A, 67 B, 139, 2.6, 3 B, 3 R

[56] References Cited

U.S. PATENT DOCUMENTS 4,741,115 5/1988 Pozzobon ..... 36/117

5,269,080 12/1993 Davis ..... 36/61

FOREIGN PATENT DOCUMENTS 71409 10/1915 Austria ..... 36/61

83171 11/1894 Germany ..... 36/61

467133 6/1992 Sweden .

*Primary Examiner*—B. Dayoan

*Attorney, Agent, or Firm*—Cushman Darby & Cushman, L.L.P.

[57] ABSTRACT

The undersole of a shoe is provided with openings, above which are mounted housings for respective spike members. Each spike member includes at least one spike mounted on an edge of a carrier, a slide, and a hinge between the carrier and the slide. The slides are slidably mounted in the housings. The carriers and housings have slidingly engaged curved surfaces which turn the spikes on the spike carriers from being generally horizontal when the spikes are withdrawn into the undersole, to being generally vertical when the spikes are extended. An operating mechanism, preferably a battery-operated electric motor-powered mechanical drive moves the slides to extend and retract the spikes.

4 Claims, 3 Drawing Sheets

27
26
11
9
2b
17
1b
4
15
20
25
7
19
16
2a
3
10
1a
24
8
12
18
21
23
22
5
6
14

ANTI-SKID DEVICE FOR FOOTWEAR

BACKGROUND OF THE INVENTION

The subject invention concerns an anti-skid device for footwear, in the form of spikes. The spikes are arranged to be displaced from an inactive position in or interiorly of the undersole of a shoe, out through an opening formed in the undersole and to an active anti-skid position on the lower face of the undersole, and reversely back into the retracted position inside the undersole.

Various types of convertible anti-skid device for footwear are known. The features common to all of them is that they are comparatively difficult to reach, and that in order to manipulate them it is necessary to stand on one foot at a time to pull out or otherwise shift each anti-skid device to its active position.

For the purpose of facilitating manipulation of an anti-skid device for footwear a construction, described in the Swedish Patent 9000311-2, has been developed. This construction, which has the advantage of allowing pull-out or retraction of two anti-skid means at the same time, one at the rear and one at the front of the undersole of a shoe, by means of one single control member, does, however, suffer from the disadvantage of insufficient strength. Because the structural components of the device cannot be given the desired dimensions on account of the limited space which is available in a shoe, this prior-art construction has a tendency to frequently malfunction.

SUMMARY OF THE INVENTION

The subject invention provides an anti-skid device for footwear which functions in an extremely reliable manner while at the same time offering the wearer excellent protection on slippery surfaces.

BRIEF DESCRIPTION OF THE DRAWINGS

The invention will be described in closer detail in the following with reference to the accompanying drawings, wherein.

DETAILED DESCRIPTION

Figure 1:
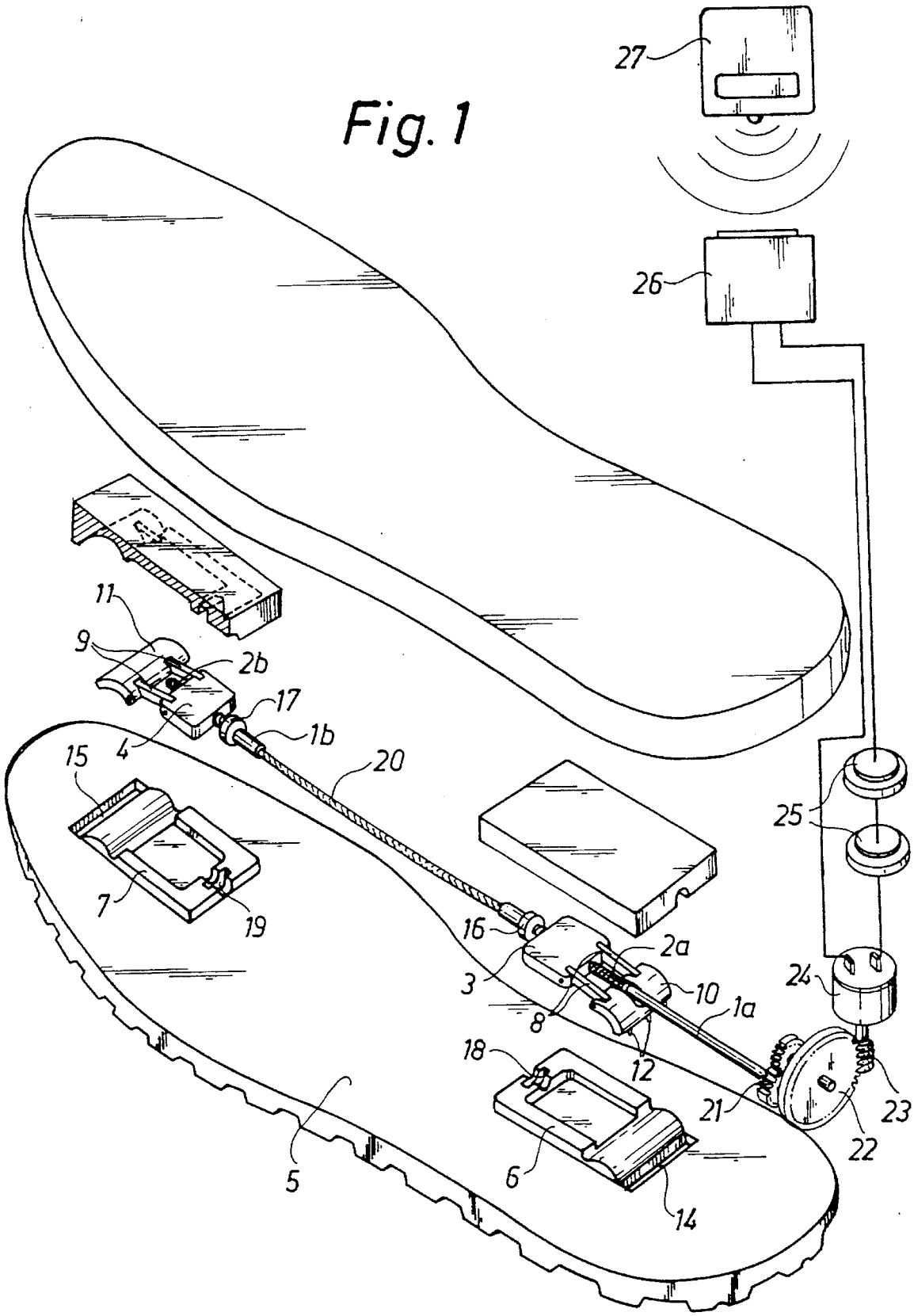
FIG. 1 illustrates the anti-skid device in accordance with the invention, in an exploded view.

The drawing figures illustrate one suitable embodiment incorporating one front and one rear anti-skid device mounted in a shoe. Each anti-skid device comprises a rotary rod 1*a* and 1*b*, respectively, each having a threaded portion 2*a* and 2*b*, respectively, in engagement with an associated sliding member 3 and 4, respectively. The sliding members 3, 4 are arranged for displacement in the longitudinal direction of the undersole 5 in housings 6 and 7, respectively, arranged on the upper face of the shoe undersole 5. Pairs of link arms 8 and 9, respectively, interconnect their associated one of the sliding members 3, 4 with the corresponding one of spike-supporting elements 10, 11, each one of which is provided at one of its edges with spikes 12 and 13, respectively. In accordance with the embodiment illustrated in the drawings, each support element 10, 11 is shaped as a curved plate and follows the movements of the associated slide member 3, 4 inside the housing 6, 7 along a curved track, which ends in a mouth portion 14, 15, formed in the undersole 5. Collars 16, 17 securely attached to their respective one of the rotary rods 1*a*, 1*b*, and mounted for free rotational movement inside their respective one of seats 18, 19 in the associated housing 6, 7, are arranged to prevent axial displacement of their respective associated rotary rod 1*a*, 1*b*.

In accordance with the embodiment of the invention illustrated in the drawings incorporating one front and one rear anti-skid device in the undersole 5, the rotary rods 1*a*, 1*b* are interconneced by means of a flexible means, such as a wire 20, to allow for pliability and flexibility of the undersole 5. In accordance with the shown embodiment, the rotary rod 1*a* is also provided with a gear drive 21 which is associated with a worm gear 23 on the drive shaft of an electric motor 24. The electric motor 24 is powered by batteries 25.

Figure 2:
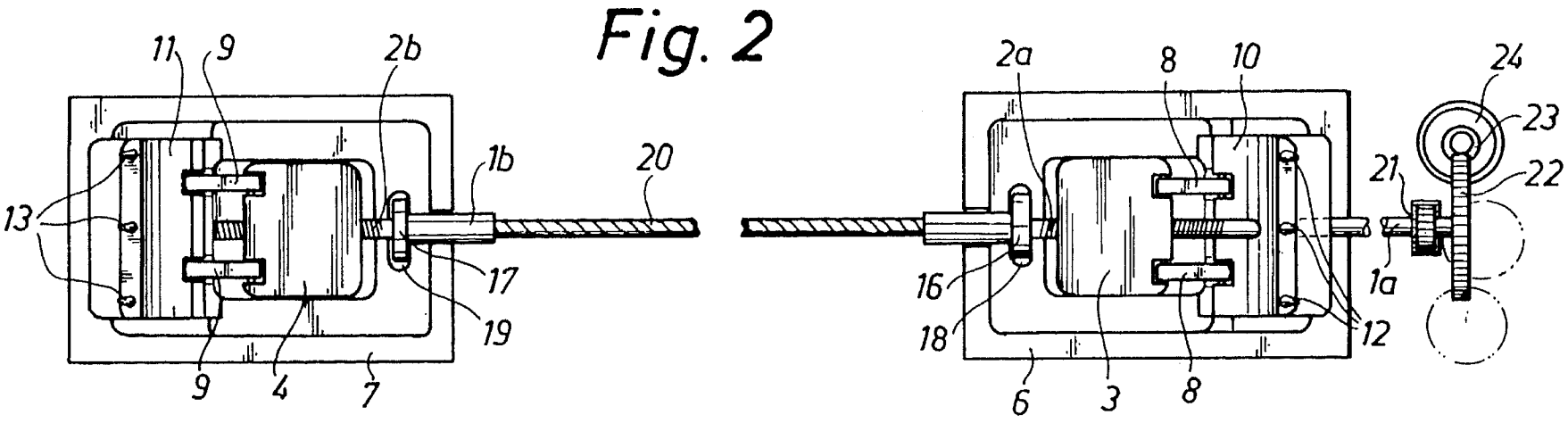
FIG. 2 illustrates the anti-skid device in a view from below.
Figure 3:
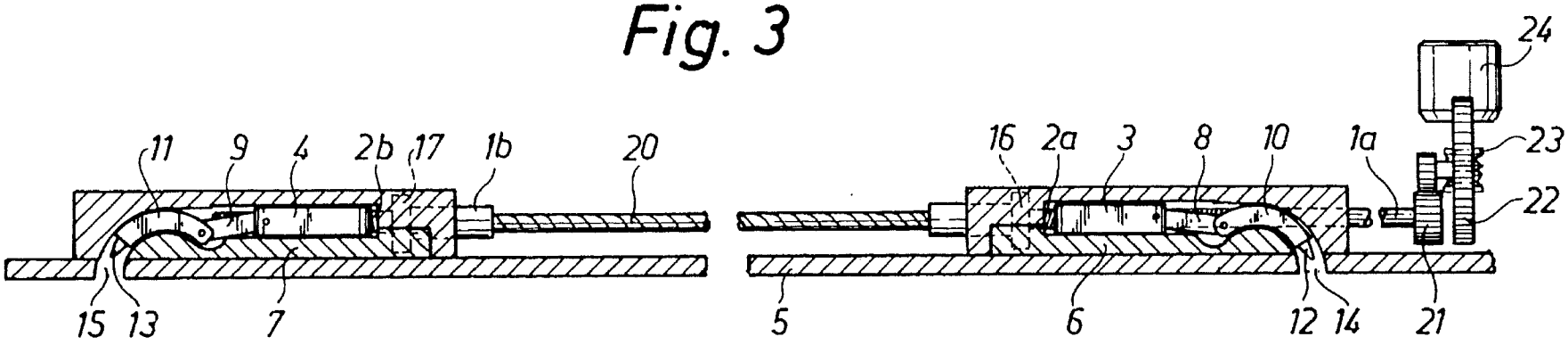
FIG. 3 is a longitudinal sectional view through the device in the inner, retracted position.
Figure 4:
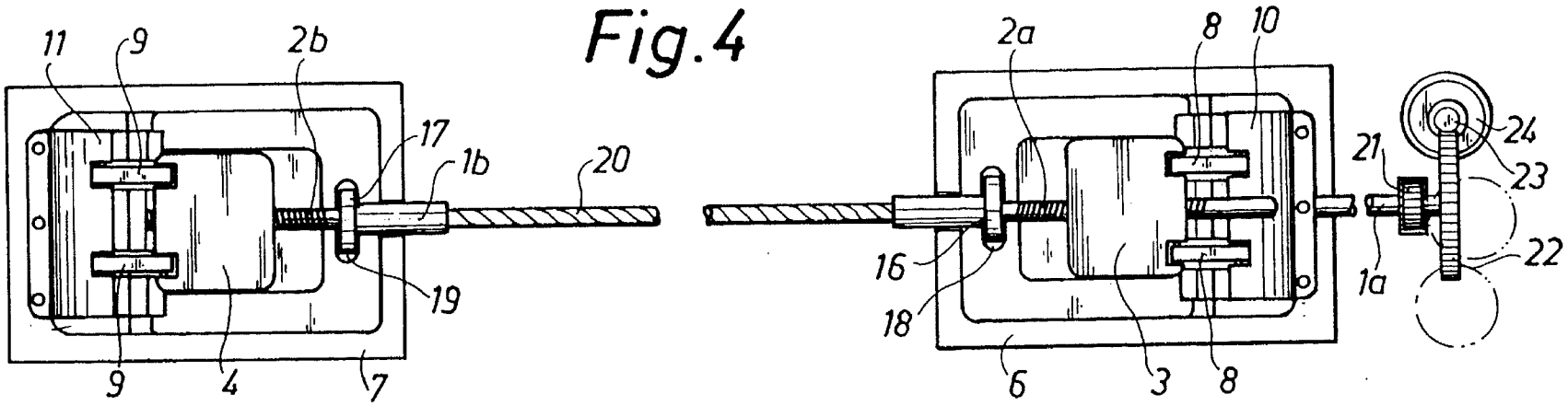
FIGS. 4 and 5 are views similar to, respectively, FIGS. 2 and 3, but showing the anti-skid device in the outer position.
Figure 5:
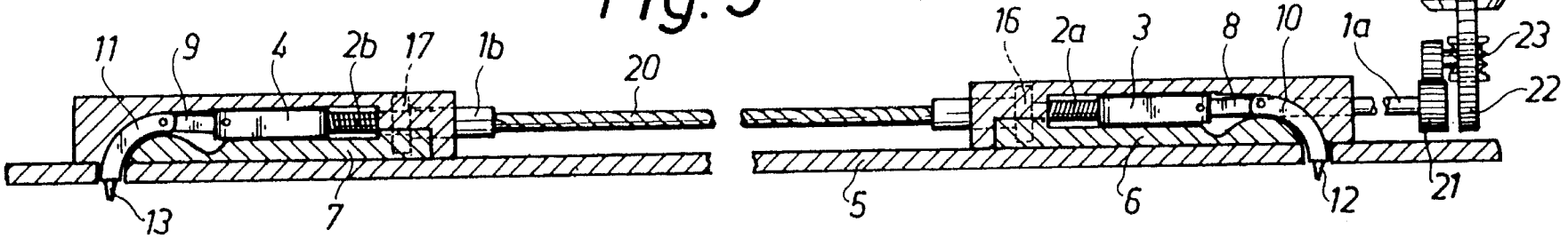

The function of the device will be explained in closer detail in the following. In their passive or inactive position, the spike-supporting plates 10, 11 with the spikes 12, 13 thereon are retracted inside the housing 6, 7, in the manner illustrated in FIGS. 2 and 3. When the motor 24 is started the motor rotates the rotary rods 1*a* and 1*b* in one direction via the gear mechanism 22 and the gear 21. The threaded portions 2*a* and 2*b* are oppositely threaded with the result that the sliding members 3, 4 are moved simultaneously in a direction away from each other. The slide members 3, 4 push the associated spike support plates 10, 11 in front of them inside the respective housing 6, 7, the spike support plates 10, 11 following the respective curved track inside the associated housing 6, 7 sufficiently far to ensure that the spikes 12, 13 project outside the lower face of the undersole 5. In this position, the motor 24 is stopped.

In a simple and convenient manner, an efficient anti-skid device is thus created underneath the undersole 5, at the front as well as at the rear thereof. When the motor 24 is started to rotate in the opposite direction, the two sliding members 3, 4 pull the spike support plates 10, 11 with the spikes 12, 13 thereon back into the position illustrated in FIGS. 2 and 3.

The anti-skid device in accordance with the invention is an efficient and at the same time convenient piece of equipment in the respect that it is possible to bring the anti-skid device to its active position on both feet at the same time and without having to lift either of the feet. As illustrated in FIG. 1, the convenient use of the device can be further increased by fitting the electric motor 24 with a sensing means 26. Like all the rest of the equipment, the sensing means 26 can be built into the shoe proper. With the aid of an activating means 27 which the wearer may carry in his or her pocket and which can be controlled, for instance, by means of ultrasonic waves, the motor 24 can be started and stopped via the sensing means 26. With such equipment it is not even necessary to bend down to activate the anti-skid device.

The invention is not limited to the embodiment illustrated in the drawings and described herein but can be varied in a variety of ways within the scope of the appended claims. It is within the scope of the invention to replace the electric motor 24 and the parts pertaining thereto with a mechanical device to effect the rotational movement of the rotary rods 1*a*, 1*b*. The anti-skid device can be used on footwear of various types, such as different kinds of sport shoes, walking shoes, boots, and the like.

I claim:

1. An anti-skid device for footwear, comprising:

a footwear undersole which is longer in a longitudinal direction than wide in a transverse direction; said undersole having a lower face; at least two openings formed in said undersole so as to open downwardly through said lower face, said at least two openings being spaced from one another in said longitudinal direction;

a respective spike member associated with each said opening; each spike member having at least one spike and being arranged to be displaced between a retracted, inactive position wherein the at least one spike is located above said lower face, and an extended, active position wherein the at least one spike protrudes downwardly from the respective opening, below said lower face;

each spike member comprising a slide, a downwardly concavely curved spike carrier plate on a transversely extending edge of which the respective said at least one spike is based, and a hinge connecting the slide and the spike carrier;

means for moving said spike members between said retracted and extended positions comprising for each spike member, a housing operatively associated with said undersole in juxtaposition with a respective said opening; each housing receiving the slide of a respective spike member for longitudinal sliding movement, guided therein, between two positions corresponding to said two positions of said spike members;

an upwardly convex surface provided on each said housing in juxtaposition with a respective said opening, and disposed to be in sliding engagement with a respective spike carrier plate, for pivoting the spike carrier plate on the respective said hinge, relative to the respective said slide, between a more horizontal disposition of the respective at least one spike corresponding to said retracted position, and a more vertical disposition of the respective at least one spike corresponding to said extended position;

for each housing, a respective longitudinally extending rotary rod disposed in threaded engagement with the respective said slide and supported relative to said undersole such that rotation in one direction slides the respective slide forwardly, and rotation in an opposite direction slides the respective slide rearwardly; and means for rotating said rods in said directions, for extending and retracting said spikes.

2. The anti-skid device of claim 1, wherein:

said means for rotating includes a rotary twist-transmitting mechanical interconnection between said rotary rods, and gear drive operatively associated with one of said rods.

3. The anti-skid device of claim 2, wherein:

said means for rotating further includes an electrically powered motor connected in driving relation to said gear drive.

4. The anti-skid device of claim 2, wherein:

said twist-transmitting mechanical interconnection is provided by a flexible wire; and said motor is a battery-operated motor.

* * * * *